United States Patent [19]

Mink

[11] Patent Number: 4,934,015

[45] Date of Patent: Jun. 19, 1990

[54] MINI-BLIND CLEANING RACK APPARATUS

[76] Inventor: Jerry C. Mink, 711-B Durham La., Ventura, Calif. 93004

[21] Appl. No.: 282,760

[22] Filed: Dec. 12, 1988

[51] Int. Cl.[5] ..... A47L 13/50

[52] U.S. Cl. ..... 15/268; 211/123; 211/206

[58] Field of Search ..... 15/268; 211/123, 175, 211/190, 206

[56] References Cited

U.S. PATENT DOCUMENTS

| | | | |
|---|---|---|---|
| 2,588,557 | 3/1952 | Morris et al. | 15/268 X |
| 2,875,971 | 3/1959 | Burns | 15/268 X |
| 2,996,747 | 8/1961 | Iori | 15/268 |
| 3,130,439 | 4/1964 | Bovaird | 15/268 |
| 3,197,797 | 8/1965 | Stanley | 15/268 |

*Primary Examiner*—Edward L. Roberts
*Attorney, Agent, or Firm*—Leon Gilden

[57] ABSTRACT

A mini-blind cleaning rack is set forth wherein a downwardly extending "U" shaped frame is provided, including a plurality of telescoping members defining the legs and base of the "U" shaped member. The terminal ends of the legs are further provided with positioning feet slidingly receiving extension legs for effecting stability of the organization. A plurality of upwardly directed clamps are slidably and adjustably positionable upon the overlying base of the "U" shaped framework with a second pair of clamps slidably and fixedly securable and downwardly directed mounted to a cross-bar adjustably positionable upon the spaced parallel legs of the "U" shaped framework. The unit accordingly accommodates and extends a mini-blind work piece between the pairs of clamps wherein the clamps may be extended to accommodate varying lengths and positioned upon the respective base and cross-bar of the apparatus to accommodate varying widths of mini-blinds.

8 Claims, 4 Drawing Sheets

MINI-BLIND CLEANING RACK APPARATUS

BACKGROUND OF THE INVENTION

1. Field of the Invention

The field of invention relates to securement racks, and more particularly pertains to a new and improved mini-blind cleaning rack wherein the same may be compactly stored during periods of non-use and efficiently assembled for arrangement of a mini-blind thereon for cleaning of the blinds.

2. Description of the Prior Art

The use of racks of varying types for securement of articles thereon is well known in the prior art. However, it may be appreciated that these devices have typically required a substantial amount of space and wherein it is desirable to store the devices not being utilized, the instant invention provides for a break-down storage rack heretofore not set forth by the prior art accommodating varying lengths and widths of venetian blinds known as mini-blinds.

Examples of prior art rack-type devices is typified in U.S. Pat. No. 2,302,233 to Maddox setting forth a collapsible clothes stand wherein an "O" shaped frame is provided with an intermediate adjustable bar to accommodate height adjustment of various clothing items to be suspended therefrom.

U.S. Pat. No. 2,438,324 to Pfeffer sets forth a drying frame including notched interconnected members for providing a drying rack for clothing garments wherein the adjustability and collapsibility of the Pfeffer patent is remote from the instant invention.

U.S. Pat. No. 2,897,911 to Bowers sets forth a support rack wherein various cylindrical pipe-like members are interengageable, including through-extending fasteners to secure the support structure together wherein pivoted "U" shaped end members are collapsible inwardly for storage of the device.

U.S. Pat. No. 3,762,951 to Hetznecker sets forth a framework wherein various members of the framework are in a substantial skin-tight relationship by one or more flexible inflatable boots whereupon paint accumulated thereon may be expanded and cracked when the boots are in an expanded configuration to assist in paint removal of accumulated paint from the rack.

U.S. Pat. No. 4,032,165 to Russell sets forth a storage and handling truck utilizing a generally elongate planar-type base with a vertically upwardly directed support directed from the base wherein an overlying rack is positionable overlying the supports for securement of various articles thereon, such as carcasses and the like for effecting transport of the same.

U.S. Pat. No. 169,058 design to Cohn sets forth a garment rack utilizing a series of stepped support members directed upwardly from a rectangular base support framework for securement of garments and the like therefrom.

As such, it may be appreciated that there is a continuing need for a new and improved mini-blind cleaning rack apparatus wherein the same addresses both the problems of storage and portability, and in this respect the present invention substantially fulfills this need.

SUMMARY OF THE INVENTION

In view of the foregoing disadvantages inherent in the known types of support racks now present in the prior art, the present invention provides a mini-blind cleaning rack apparatus wherein the same may be compactly stored when not in use and may be further easily and efficiently erected during periods of need. As such, the general purpose of the present invention, which will be described subsequently in greater detail, is to provide a new and improved mini-blind cleaning rack apparatus which has all the advantages of the prior art support racks and none of the disadvantages.

To attain this, the present invention comprises an interlocking framework defining a "U" shaped support framework with a first pair of upwardly directed first clamps slidably and adjustably mounted to the overlying base of the "U" shaped framework with a second pair of clamps slidably and adjustably mounted to a cross-bar; the cross-bar being vertically positionable and securable to the downwardly extending "U" shaped legs of the framework. Support and stabilizing feet are receivable within the terminal lower ends of the "U" shaped legs wherein the feet are further formed with stub shafts, the stub shafts receiving stabilizing extensions frictionally securable over the stub shafts to impart stability to the framework during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mini-blind cleaning rack apparatus which has all the advantages of the prior art mini-blind cleaning rack apparatus and none of the disadvantages.

It is another object of the present invention to provide a new and improved mini-blind cleaning rack apparatus which may be easily and efficiently manufactured and marketed.

It is a further object of the present invention to provide a new and improved mini-blind cleaning rack apparatus which is of a durable and reliable construction.

An even further object of the present invention is to provide a new and improved mini-blind cleaning rack apparatus which is susceptible of a low cost of manufacture with regard to both materials and labor, and which accordingly is then susceptible of low prices of sale to the consuming public, thereby making such mini-blind cleaning rack apparatus economically available to the buying public.

Still yet another object of the present invention is to provide a new and improved mini-blind cleaning rack apparatus which provides in the apparatuses and methods of the prior art some of the advantages thereof, while simultaneously overcoming some of the disadvantages normally associated therewith.

Still another object of the present invention is to provide a new and improved mini-blind cleaning rack apparatus wherein the same includes a plurality of interengageable links to provide a "U" shaped framework with vertical and horizontal adjustably mounted clamps to accommodate varying lengths and widths of mini-blinds to be cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
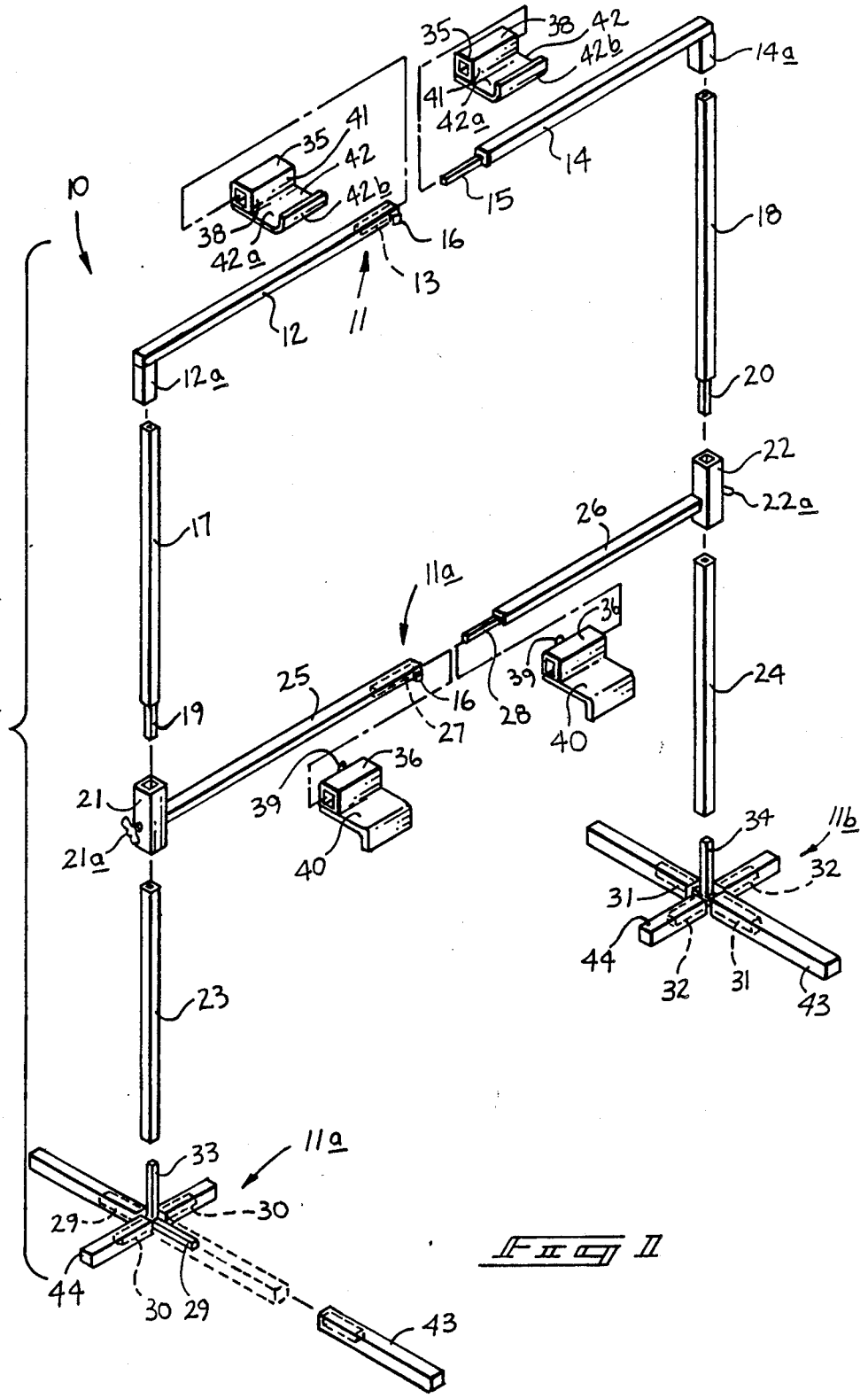
FIG. 1 is an isometric illustration of the instant invention somewhat expanded.

With reference now to the drawings, and in particular to FIGS. 1 to 5 thereof, a new and improved mini-blind cleaning rack apparatus embodying the principles and concepts of the present invention and generally designated by the reference numeral 10 will be described.

More specifically, the invention comprising the mini-cleaning rack apparatus 10 essentially comprises an overlying elongate base member 11 of parallelepiped construction with a plurality of parallel spaced downwardly depending legs including a vertically adjustable cross-bar 11*a* with stabilizing feet 11*b* and 11*c* receivable within respective terminal ends of the spaced legs.

The base member 11 includes a first "L" shaped leg 12 formed with a first cavity 13 at a forward end to receive a dimensionally reduced first end 15 of complementary configuration to the parallelepiped cavity 13. The dimensionally reduced first end 15 is formed at a forward terminal end of the second "L" shaped leg 14. The respective first and second "L" shaped legs 12 and 14 include respective downwardly extending hollow legs 12*a* and 14*a* for receiving respective first intermediate leg 17 and second leg intermediate 18, each of parallelepiped configurations therewithin the respective cavities of the first and second hollow legs 12*a* and 14*a*. The use of a flush-mounted set screw 16 extending through a wall of the first "L" shaped leg 12 to secure the first reduced end 15 within the cavity 13 of the first "L" shaped leg 12 is provided.

Each of the respective first and second intermediate legs 17 and 18 are each provided with a dimensionally reduced second end 19 and a respective third end 20 for complementary reception within the cavities of first and second bottom legs 23 and 24 respectively. The first and second bottom legs are formed with hollow interiors to complementarily accept the respective second and third ends 19 and 20 therewithin.

First and second slide members 21 and 22 are provided with through-extending hollow interiors of a cross-sectional configuration approximately equal to the cross-sectional configuration of the exterior surfaces of the first and second intermediate legs 17 and 18 and the respective first and second bottom legs 23 and 24 to enable the slides 21 and 22 to vertically be repositioned along the length of the respective intermediate and bottom legs.

The respective first and second slides 21 and 22 have orthogonally secured thereto respective first cross-brace member 25 and respective second cross-brace member 26. The first cross-brace member 25 is provided with a second cavity 27 of complementary configuration to receive the dimensionally reduced third end 28 formed at the outer terminal end of the second cross-brace member 26. It should be noted that the first and second "L" shaped legs 12 and 14 and the first and second cross-brace members 25 and 26 are formed of a first cross-sectional configuration with the first and second intermediate legs 17 and 18 and bottom legs 23 and 24 formed of a second cross-sectional configuration.

Telescopingly received within lower terminal ends of the respective first and second bottom legs 23 and 24 are the stabilizing feet 11*b* and 11*c* comprising a first foot boss 33 and a respective second foot boss 34 of cross-sectional configuration dimensioned to be received within the parallelepiped hollow interior of the first and second bottom legs 23 and 24. The respective first and second foot bosses 33 and 34 are orthogonally secured to intersections of respective foot braces. The first foot brace 29 is orthogonally directed and medially intersecting a second foot brace 30. The second foot brace 30 is of a length less than that of the first foot brace 29 where in a similar fashion, a third foot brace 31 orthogonally and medially intersects a fourth foot brace 32 wherein the fourth foot brace 32 is of a length equal to the second foot brace 30 wherein each are of a lesser length than the respective first and third foot braces 29 and 31. Accordingly in this manner, the foot braces 29 through 32 receive stabilizing extensions slidingly thereover. First stabilizing extensions 43 are frictionally engageable and are provided with a complementary internal cavity to receive therewithin respective foot braces 29 and 31 with second stabilizing extensions 44 of a lesser length than the first stabilizing extensions 43, also formed with internal cavities to complementarily receive the respective second and fourth foot braces 30 and 32. In this manner, a user is provided with reduced obstruction between the downwardly extending legs of the framework without adversely effecting the stability of the apparatus.

Figure 4:
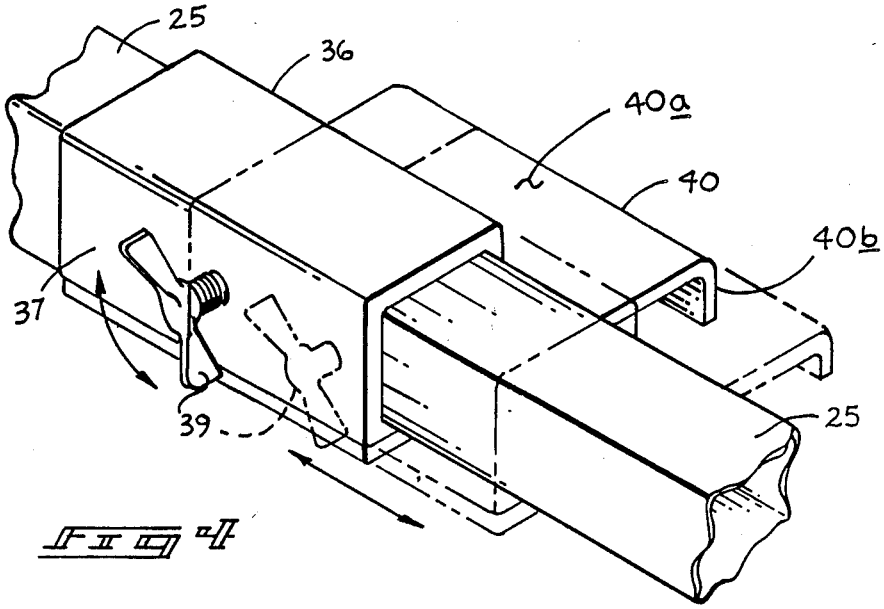
FIG. 4 is an isometric illustration detailing a typical clamp secured to an associated framework member.

A plurality of first clamps 35 are slidingly positionable along the base member 11 with a second pair of second clamps 36 slidingly positionable along the cross-bar 11*a*. Reference to FIG. 4 illustrates a typical second clamp 36 formed with a tubular slide 37 of complementary internal cross-sectional configuration to a respective first cross-brace 25. The tubular slide has formed therethrough a first threaded securement member 39 to fixedly secure the slide 37 with respect to the associated cross-brace. An "L" shaped downwardly depending grasping leg 40 includes a first plate member 40*a* integrally secured to a bottom surface of the tubular slide 37 and formed with a downwardly extending second plate member 40*b*. The first clamps are of similar construction with respective "L" shaped grasping legs 42 upwardly directed and integrally secured to respective top surfaces of respective tubular slides 38. Similarly, the upwardly directed "L" shaped grasping legs 42 are formed with outwardly directed plate members 42*a* integrally formed to upwardly directed second plate members 42*b* to define third and fourth plate members respectively wherein the respective fourth plate members 42*b* are oriented in an upward direction, as opposed to the second plate members 40*b* of the respective second clamps 36.

Figure 2:
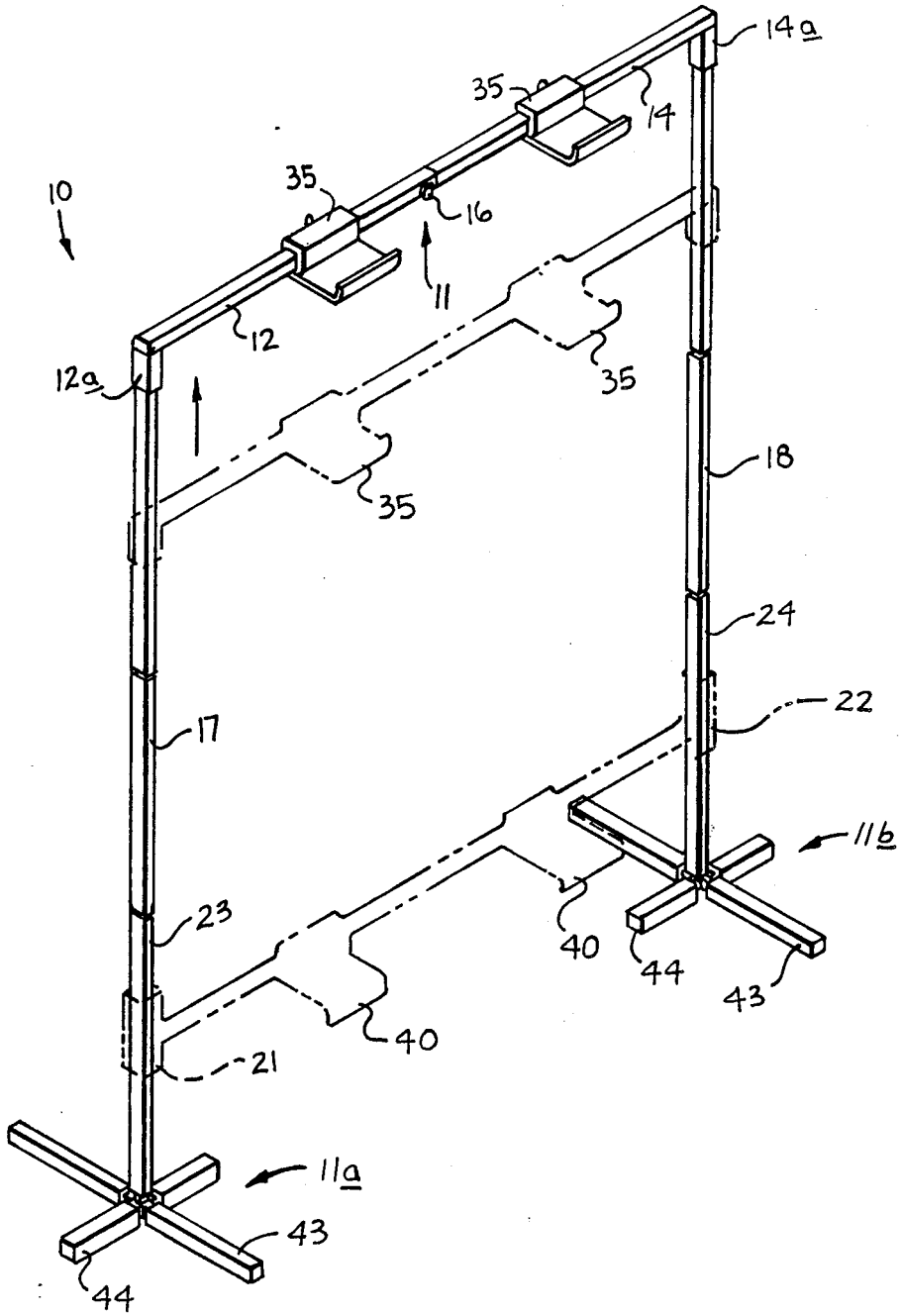
FIG. 2 is an isometric illustration of the instant invention illustrating various positions of the clamps during use.
Figure 3:
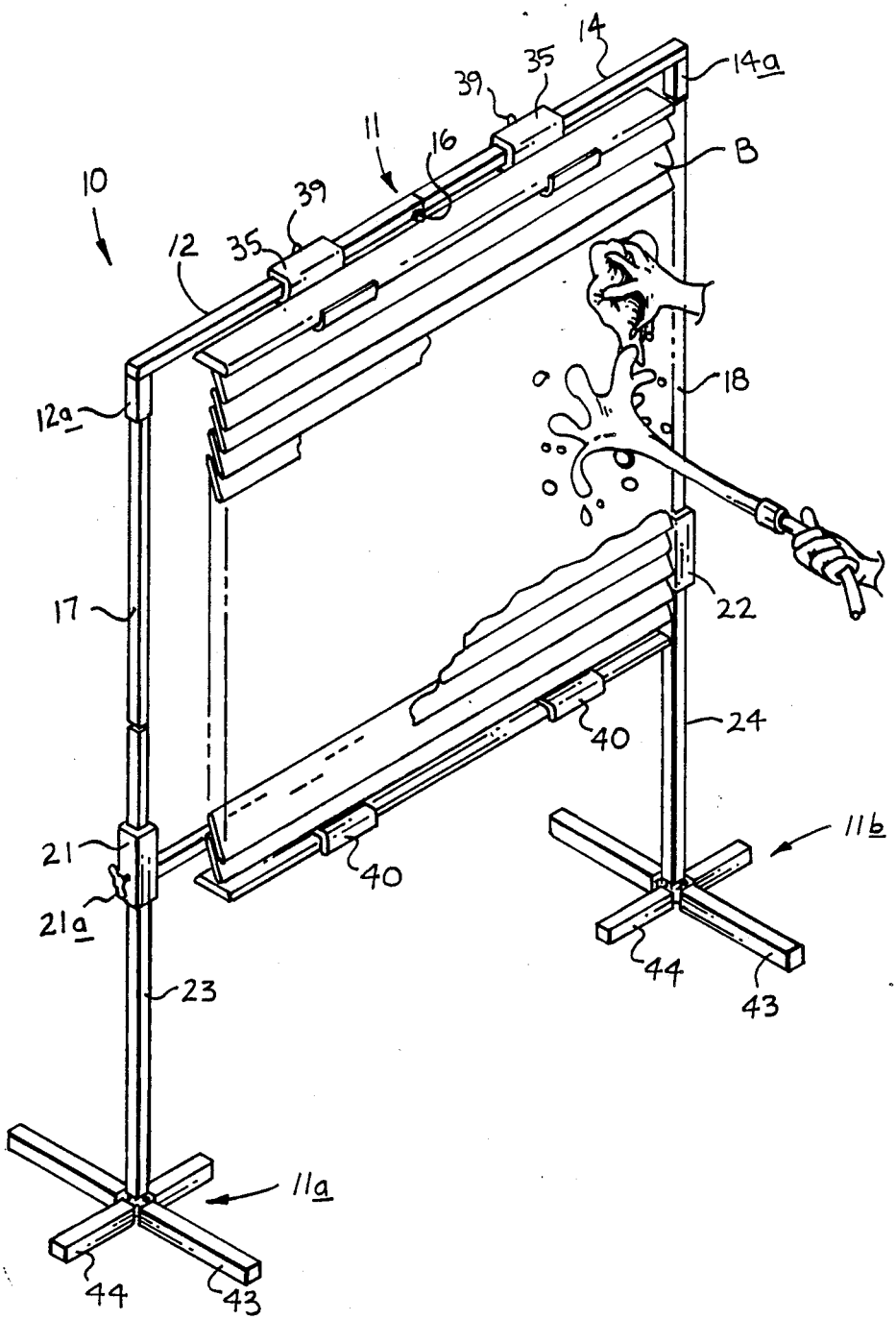
FIG. 3 is an isometric illustration of the instant invention with a typical mini-blind secured thereto.
Figure 5:
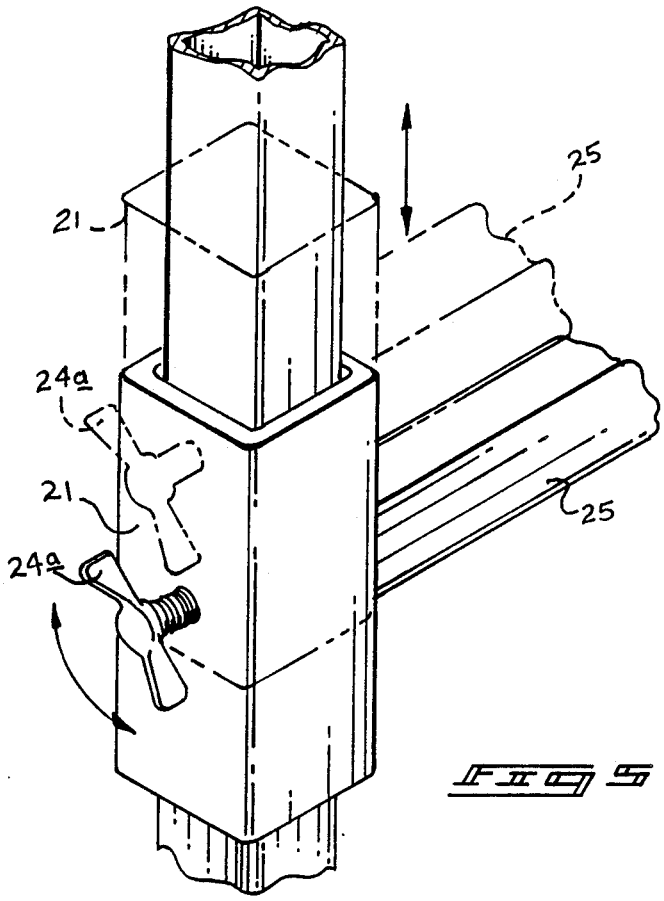
FIG. 5 is an isometric illustration illustrating the relationship of the cross-bar to the legs of the framework.

It should also be note that the first and second slides 22 are formed with respective threadedly directed clamps 21*a* and 22*b* to arrest the position of the respective slides 21 and 22 about respective intermediate and bottom legs 17 and 23 and 18 and 24, as illustrated in FIG. 2 for example. It should also be noted that in the event a mini-blind of reduced length is utilized, the first and second intermediate legs 17 and 18 may be removed and the base member 11 positioned overlying the bottom legs 23 and 24 to produce an apparatus of reduced height and associated bulk. Further reference to FIG. 2 will note that additional intermediate legs may be added as deemed necessary to provide a height of apparatus as necessary to accommodate associated mini-blinds "B" to effect a cleaning operation, as illustrated in FIG. 3 for example. The respective first and second clamps may be in this manner positioned vertically by the adjustment of the cross-brace 11*a* and removal or additioned respective intermediate legs 17 and 18. The clamps may also be positioned horizontally about the respective base and cross-brace members to accommodate lines "B" of various widths and clamped in position by use of the threaded securement members 39.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A break-down rack for adjustable securement of window coverings comprising, a "U" shaped framework including an upper base member and a plurality of spaced parallel downwardly depending leg members each removably mounted to said base member at opposite ends of the base member at upper terminal ends of each leg member, and a stabilizing foot removably mounted to lower terminal ends of each leg member and extending orthogonally outwardly therefrom, and an elongate cross-bar slidably mounted to each leg member including a slide member orthogonally and integrally secured to opposite terminal ends of said cross-bar wherein each sliding member slidingly encompasses a respective leg member, and a first locking member threadedly and orthogonally extending through each slide member to selectively engage a respective leg member and secure said cross-bar in a predetermined vertical position relative to said leg members, and a first clamp pair slidingly secured to said base member and a second clamp pair slidingly secured to said cross-bar for securement of a window covering between said first and second clamp pairs.

2. A break-down rack as set forth in claim 1 wherein said base member includes a first and second "L" shaped leg, wherein said first "L" shaped leg is formed with a first cavity at a forward terminal end thereof for complementarily receiving a first reduced end of a dimensional cross-sectional configuration less than the cross-sectional configuration of the first and second "L" shaped legs, wherein each first and second "L" shaped leg includes a downwardly depending hollow leg formed with an interior second cross-sectional configuration substantially equal to the cross-sectional configuration of each leg member.

3. A break-down rack as set forth in claim 2 wherein each leg member includes an upper intermediate leg formed with a dimensionally reduced second end of a cross-sectional configuration less than the intermediate leg wherein the cross-sectional configuration of said intermediate leg is equal to that of said bottom leg, and further said bottom leg is provided with a cavity for receiving said reduced second end.

4. A break-down rack as set forth in claim 3 wherein a lower terminal end of each bottom leg is provided with a cavity for complementarily receiving an upwardly extending boss orthogonally and integrally secured to a plurality of first and second foot braces formed to each stabilizing foot.

5. A break-down rack as set forth in claim 4 wherein each first foot brace is orthogonally directed to and medially intersects a second foot brace and wherein each first foot brace of each stabilizing foot is of a lesser lineal length than each second foot brace and wherein each first foot brace is in aligned relationship to each other and wherein each second foot brace is in aligned relationship to each other.

6. A break-down rack as set forth in claim 5 wherein each stabilizing foot further comprises a sleeve formed with a cavity for receiving each foot brace.

7. A break-down rack as set forth in claim 6 wherein each clamp of said first clamp pair comprises a tubular slide formed with an elongate interior through-extending cavity of a cross-sectional configuration equal to the cross-sectional configuration of said base member and further including an "L" shaped plate integrally secured to a lowermost surface of said slide formed with an upwardly depending clamp leg.

8. A break-down rack as set forth in claim 7 wherein each clamp of said second clamp pair includes a further tubular slide defined by an elongate internal cavity of cross-sectional configuration equal to a cross-sectional configuration defined by said cross member and further including an "L" shaped plate integrally secured to and extending outwardly of said further slide formed with a distal leg depending downwardly from said plate.

* * * * *